United States Patent [19]

Jones

[11] 3,995,924

[45] Dec. 7, 1976

[54] APPARATUS FOR SORTING CLOTHES

[76] Inventor: Charlotte B. Jones, 17621 Irvine Blvd., Suite 101, Tustin, Calif. 92680

[22] Filed: Feb. 3, 1975

[21] Appl. No.: 546,310

[52] U.S. Cl. ..... 312/211; 312/254; 248/95; 232/24

[51] Int. Cl.[2] ..... B65B 67/12; A47B 81/00

[58] Field of Search ..... 312/211, 254; 248/95, 248/97, 98, 99, 101, 132, 149, 188.7, 100; 232/24, 30, 31

[56] References Cited

UNITED STATES PATENTS

| | | | |
|---|---|---|---|
| 375,406 | 12/1887 | Wilson et al. | 248/149 |
| 1,025,974 | 5/1912 | Gipple | 248/97 |
| 1,225,866 | 5/1917 | Schrears | 248/97 |
| 1,715,994 | 6/1929 | Cunningham | 248/99 |
| 2,625,973 | 1/1953 | Weldon et al. | 248/99 |
| 2,923,513 | 2/1960 | Johnson | 248/188.7 |
| 3,222,019 | 12/1965 | Weisberg | 248/97 |
| 3,229,940 | 1/1966 | Kagels | 248/132 |
| 3,752,476 | 8/1973 | Mahoney | 248/188.7 |
| 3,771,752 | 11/1973 | Meeh | 248/98 |
| 3,838,838 | 10/1974 | Seaman, Jr. | 248/188.7 |

FOREIGN PATENTS OR APPLICATIONS

| | | | |
|---|---|---|---|
| 602,478 | 4/1933 | Germany | 248/95 |

*Primary Examiner*—Paul R. Gilliam
*Assistant Examiner*—Victor N. Sakran

[57] ABSTRACT

An automatic clothes sorter adapted for use with a standard clothes hamper, whereby the interior of the hamper is divided into four equal-sized, removable, bag compartments of a durable material for receiving soiled clothing, the clothing being sorted and disposed — as desired — according to color, type, etc., within the designated compartments. The clothes sorter comprises a plurality of bags, forming the compartments, said bags having eyelets secured therein to receive eye hooks which are mounted to the top peripheral opening of the clothes hamper and to a central support stand, wherein the stand includes a telescoping center post, adjustable for various heights, and an adjustable base member which is centrally positioned within the clothes hamper.

4 Claims, 6 Drawing Figures

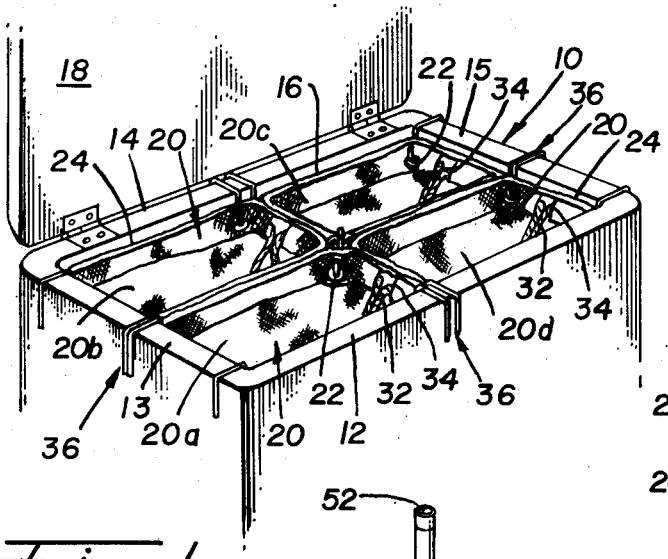
Fig. 1.
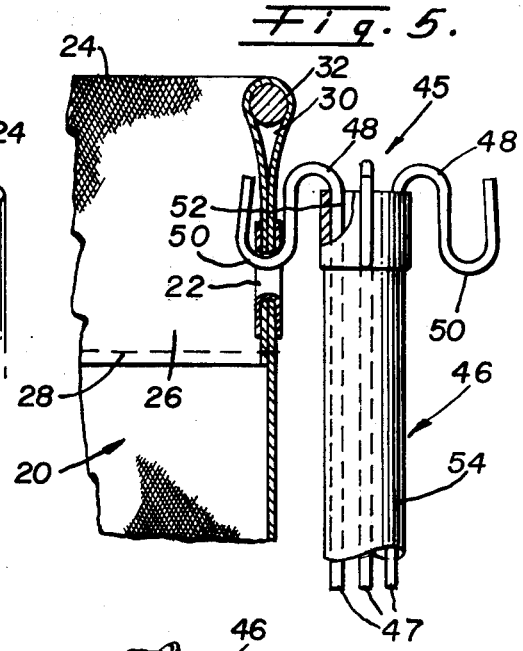
Fig. 5.
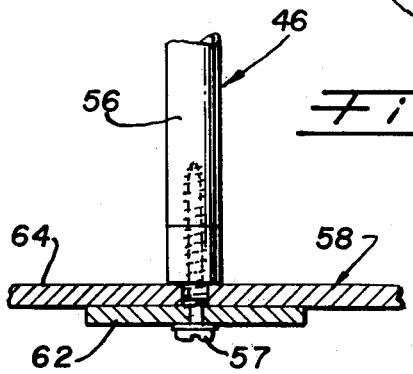
Fig. 3.
Fig. 6.
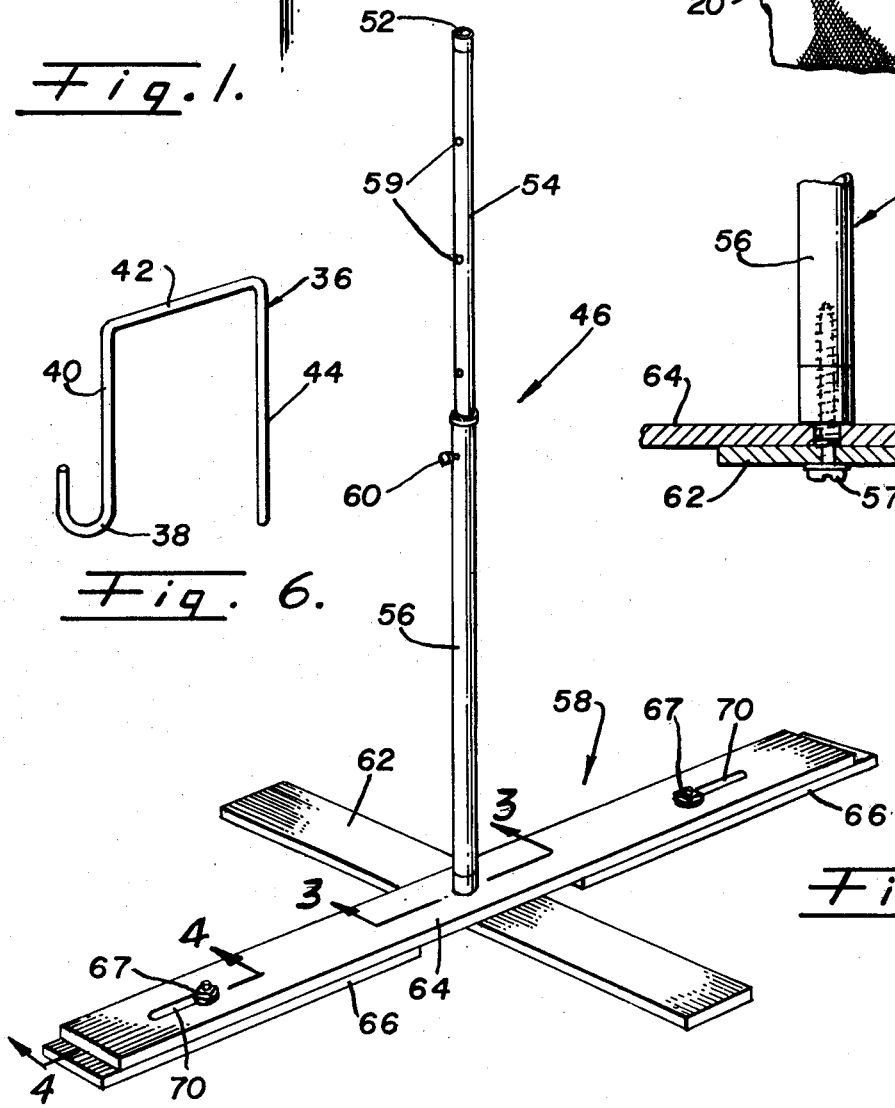
Fig. 2.
Fig. 4.
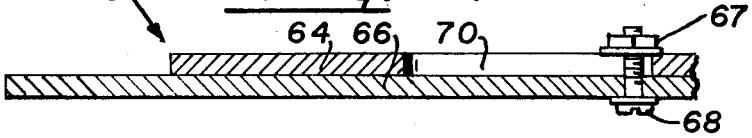

APPARATUS FOR SORTING CLOTHES

BACKGROUND

1. Field of the Invention

This invention relates in general to the disposing of soiled clothes, and more particularly to the separating of soiled clothing, toweling, sheeting, etc., into designated bags forming a plurality of compartments adapted to be combined with the standard clothes hamper.

2. Description of the Prior Art

At the present time, there are a great variety of receptacles used for storing soiled clothing to be washed. The most well known storage unit that is readily and commercially available is the clothes hamper. These clothes hampers vary in size and all are provided with a single compartment defined by its four walls and a hinged cover.

Thus, as clothes are soiled, they are disposed within the standard hamper which does not have the provision for the sorting of various types and colors of clothes. As can be understood, the sorting of clothing prior to washing is essential — so that, for example, white clothes can be washed separately from colored clothes in order to retain their brightness; light colored clothes can be washed separately from dark colored clothes to prevent "running" of colors; wash and wear clothes can be washed together on the "wash and wear" cycle of the washing machine; delicate clothes can be washed on the "delicate" cycle; etc.

Therefore, in order to conserve time, there is a need for an apparatus that will allow the separation of soil clothing at the time the clothing is disposed within the hamper. In addition, there is a need whereby the separated clothes can be easily transferred from the hamper to the washing machine.

To the applicant's knowledge, there is no such apparatus available at present that can be combined with the well-known clothes hampers and that will allow the type of separation as heretofore mentioned.

SUMMARY

The present apparatus, in combination with the well-known clothes hamper, provides a means whereby various types of clothing can be separated at the time they are disposed and stored in the hamper by means of four, equal-sized, removable compartments.

Accordingly, the present invention comprises a plurality of bags which define the four compartments of the clothes hamper. Each of these bags is provided with at least four eyelets secured adjacent the upper open end of each bag, wherein the eyelets are adapted to be supported by various eye hooks, some of which are designed to hook about the upper peripheral edge of the hamper opening, together with additional eye hooks received in a central support stand.

The support stand comprises an adjustable, telescoping, center post to accommodate the various heights of the different sizes of hampers. The center post is affixed to a base member having crossed, extended legs, wherein at least one set of legs is adjustable to fit the length of the compartment of the clothes hamper.

OBJECTS AND ADVANTAGES

The present invention has for an important object a provision whereby the well-known clothes hamper can be readily divided into four separate compartments defined by removably-hung bags therein.

It is another object of the invention to provide an apparatus for sorting soiled clothes of various types and colors, the apparatus being adapted for use in combination with various sizes of clothes hampers.

It is further another object of the invention to provide an apparatus for sorting soiled clothes wherein a central, telescoping, support stand is accommodated within the hamper and adapted to receive a plurality of eye hooks for supporting the inner corners of the selective bags thereon, and wherein said bags include eyelets to receive said eye hooks.

It is a further object of the invention to provide a clothes-sorting apparatus that conserves time — a minimum of 10 hours being spent per year for a family of two that washes clothes once a week; more frequent laundering for larger numbers of people increases the number of labor hours saved.

A still further object of the invention is to provide an apparatus for sorting soiled clothes wherein the use of said apparatus can be instrumental in teaching young and old of either gender to properly separate items for laundering.

It is another object of the invention to provide an apparatus of this character wherein soiled clothes need only be handled once, since the bags can be easily removed from the hamper and carried to the washing machine, or taken to a commercial, coin-operated laundry — each bag being provided with a draw string.

It is still another object of the present invention to provide an apparatus of this type that is simple and durable in construction.

It is a further object of the invention to provide a clothes-sorting apparatus having relatively few moving parts.

Other characteristics, advantages and objects of this invention can be more readily appreciated from the following description and appended claims. When taken in conjunction with the accompanying drawings, this description forms a part of the specification wherein like references and characters designate corresponding parts in several views.

DESCRIPTION OF THE DRAWINGS

Referring more particularly to the accompanying drawings, which are for illustrative purposes only:

FIG. 1 is a partial, perspective view illustrating the present invention disposed within a clothes hamper;

FIG. 2 is an enlarged, perspective view of the adjustable, central-support stand;

FIG. 3 is an enlarged, cross-sectional view taken substantially along line 3—3 of FIG. 2;

FIG. 4 is an enlarged, cross-sectional view taken substantially along line 4—4 of FIG. 2, wherein the adjusting means for the base member is shown.

FIG. 5 is a view of a portion of the removable bag as it is attached to the upper portion of the support stand by means of an eyelet and eye hook; and FIG. 6 is a perspective view of an eye hook used to support the bag with respect to the side walls of the clothes hamper.

DESCRIPTION OF THE PREFERRED EMBODIMENT

Referring to the drawings and more particularly to FIG. 1, there is partially illustrated a clothes hamper, generally indicated at 10, having four typical sides 12, 13, 14 and 15, respectively, which define a rectangular opening 16. Generally, such hampers are also provided with a hinged cover, such as 18.

As is well known, clothes hampers of this type have one large compartment in which soiled clothes are disposed and stored until the time the items therein are to be washed. Hence, the clothes must be emptied and carried to the washing machine or coin-operated laundry, at which time the items are separated according to color and type of material.

However, with the combination of the present invention disposed within the large compartment of the hamper, the clothes can be automatically separated at the time they are placed therein. Hence, the present invention provides an apparatus for sorting soiled clothes by means of a plurality of elongated bags 20 which are disposed and secured in said hamper compartment to form four separate and distinct compartments 20*a*, 20*b*, 20*c* and 20*d*, respectively. Thus, the bags are juxtapositioned in such a manner as to fill the entire opening 16 of the hamper 10, as seen in FIG. 1.

The length of the bags will be determined by the depth of the hamper; however, such dimensions as 9½ inches × 5 inches × 23 inches are contemplated. It is important, of course, that each bag be of a different color, print, or marking designating the particular items to be placed therein in order to facilitate sorting. For example, bag 20*a* could be made of a white durable material for storing white clothes; bag 20*b* could be provided with a light yellow material for light-colored clothes; 20*c* might be a navy blue color for dark clothes; and bag 20*d* perhaps a multi-colored material for items such as towels.

Each bag is designed with eyelets 22 secured in four corners thereof adjacent the upper, open, free end 24. Said open free end 24 is provided with an overlapping flange portion 26 which is shown as at 28 wherein a peripheral passge 30 is defined. Within said passage is a draw string 32 whereby the open end 24 can be closed by drawing said string 32 which extends from the passage, as shown at 34 in FIG. 1.

Thus, eyelets 22 and a plurality of eye hooks provide a means by which the bags are supported and held open to receive the items of clothes. The eye hooks are of two designs. The first to be described is the type of hook used to removably attach the bags to the side walls 12, 13, 14 and 15. Each of these hooks 36 (See FIG. 6.) comprises a single shaped metal or plastic wire having a hook end 38 which extends vertically upward at 40, and then is bent horizontally at 42 and bent downwardly as at 44 to provide a U-shaped opening to receive the peripheral edge of the hamper 10, as seen in FIG. 1. This particular hook 36 is used to support three corners of each bag 20, whereas the second type of eye hook 45 supports the fourth corner and is, itself, received and supported in the telescoping, central-support post, generally indicated at 46.

The configuration of hook 45 comprises an elongated metal or plastic wire 47 bent at its upper end, forming an inverted U at 48 and extending downwardly a short distance, wherein the wire is bent back on itself again at 50 to form an open-end, U-shaped hook to receive one of the bag eyelets 20, as seen in FIG. 5. The elongated portion 47 of hook 45 is adapted to be received in the central bore 52 of the telescopic-support rod 54. Said rod 54 is slidably received in a lower elongated sleeve 56 which is fixedly secured to the base-member screw 57, indicated generally at 58. Means for adjusting the height of the support stand is incorporated in rod 54 having disposed therein a plurality of aligned holes 59 which are adapted to receive a threaded thumb screw 60 mounted to sleeve 56, as seen to FIG. 2. Thus, the height of post 46 is determined by the height of the hamper 10.

The base member 58 comprises a pair of extending leg members 62 and 64. The first leg member 64 is affixed to the second leg member 62, said leg 62 being secured intermediate the ends of said leg 64 and at right angles thereto, forming a substantially cross-configuration — said leg 62 being shorter in length than the first leg 64, so that it is readily positioned with the width portion of the hamper bottom. Accordingly, the length of said leg 64 is longer than leg 62 and, in addition, leg 64 is provided with an adjusting leg means comprising a pair of moveable feet members 66 located at each end of leg 64; and leg 64 includes a nut 67 and a screw 68 which passes through foot 66 and is positioned within an elongated slot 70 disposed within leg 64 — hence, said leg 64 can be adjusted along its length.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. In combination with an apparatus for sorting and storing clothes which is removably disposed within the compartment of a clothes hamper, wherein the improved apparatus comprises:

an adjustable central-support stand positioned within said compartment of said hamper, said central-support stand includes a central telescoping support post, means for adjusting the height of said telescoping support post, wherein said telescoping support post is affixed to an adjustable base member and means for securing said support post to said base member;

a plurality of bags equally arranged and juxtapositioned within said hamper, and removably secured therein; and means for removably securing said bags in said hamper;

wherein said means for removably securing said bags in said hamper comprises a plurality of eye hooks mounted to said hamper and said cnetral telescoping support post, whereby the end of each bag is removably secured thereto said base member comprising a first elongated leg member and a second leg member secured to said first leg member intermediate the ends thereof and at right angles thereto, forming a substantially cross - configuration therewith.

2. An apparatus for sorting and storing clothes as recited in claim 1, wherein said central telescoping support post comprises:

an elongated sleeve affixed at the lower end thereof to said base member; and a support rod having a bore disposed therein, said rod being telescopically received within said elongated sleeve.

3. An apparatus for sorting and storing clothes as recited in claim 2, wherein said means for adjusting the height of said telescoping support post comprises:

a plurality of vertically-aligned holes disposed in said support rod; and a thumb screw received in said elongated sleeve and one of said holes in said rod.

4. An apparatus for sorting and storing clothes as recited in claim 3, wherein each of said bags includes a draw string slidably disposed within a passage formed about the peripheral opening of said bag, whereby said bag can be closed when removed from said hamper.

* * * * *